US005935385A

United States Patent [19]

Grabscheid et al.

[11] Patent Number: 5,935,385

[45] **Date of Patent: *Aug. 10, 1999**

[54] PRESS DEVICE WITH OIL ASPIRATION DEVICE

[75] Inventors: Joachim Grabscheid, Heuchlingen; Christian Schiel; Andreas Schuette, both of Heidenheim, all of Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/837,469

[22] Filed: Apr. 18, 1997

[30] Foreign Application Priority Data

Apr. 19, 1996 [DE] Germany ..... 196 15 654

[51] Int. Cl.[6] ..... D21F 3/02

[52] U.S. Cl. ..... 162/358.3; 162/272

[58] Field of Search ..... 162/358.3, 361, 162/272

[56] References Cited

U.S. PATENT DOCUMENTS 4,673,461 6/1987 Roerig et al. ..... 162/358.3
5,645,691 7/1997 Zuefle et al. ..... 162/358.3

FOREIGN PATENT DOCUMENTS 3030233 2/1982 Germany ..... 162/358.3
3224007 12/1983 Germany ..... 162/358.3
4415645 11/1995 Germany .

OTHER PUBLICATIONS

Meinecke et al., "Zum Einsatz von Schuhpressen bei Schreib–und Druckpapieren", *Wochenblatt Fur Papierfabrikation* [Weekley Gazette of Paper manufacturing], pp. 173–178 (May 1988).

*Primary Examiner*—Karen M. Hastings
*Attorney, Agent, or Firm*—Greenblum & Bernstein, P.L.C.

[57] ABSTRACT

A press device, e.g., a shoe press device, for treating a sheet of material, e.g., paper or cardboard, in an elongated press gap elongated in a travel direction of the sheet of material. The press device may include a flexible roll jacket that runs around a stationary carrier, an opposing face that forms the elongated press gap with the flexible roll jacket, and at least one of a hydrodynamically and hydrostatically lubricated support element supported on the carrier. The support element may include a compression face adapted to a shape of the opposing face and at least one cloth belt guided through the elongated press gap. The support element may further include an entry face for the flexible roll jacket and for the cloth belt and positioned before the compression face in the travel direction of the sheet of material. A lubricant aspiration device is located before the support element in the travel direction, and is spaced from the roll jacket during normal operation.

31 Claims, 2 Drawing Sheets

PRESS DEVICE WITH OIL ASPIRATION DEVICE

CROSS-REFERENCE OF RELATED APPLICATION

The present invention claims the priority under 35 U.S.C. § 119 of German Patent Application No. 196 15 654.8 filed on Apr. 19, 1996, the disclosure of which is expressly incorporated by reference herein in its entirety.

BACKGROUND OF THE INVENTION

1. Field of the Invention

The present invention relates to a press device, e.g., a shoe press device, for treating a sheet or web of material in an elongated press gap or nip, i.e., elongated in a travel direction of the sheet of material. The elongated press nip may be formed between a flexible roll jacket, running around a stationary carrier, and an opposing surface. The flexible roll jacket may be pressed against the opposing surface by at least one hydrodynamically and/or hydrostatically lubricated support element supported on the carrier, e.g., a press shoe. The support element may include a compression face that adjusts its shape to complement the shape of the opposing face. In addition, to the material sheet to be treated, at least one cloth belt, e.g., a de-watering felt, a water removal screen, or the like, may be guided through the press gap.

2. Discussion of Background Information

Press devices similar to the type generally discussed above are known in the art, however, utilizing these devices for guiding a cloth belt on a flexible roll jacket before a press gap has been avoided. FIG. 16 of the publication "Wochenblatt für Papierfabrikation May 1988" [Weekly Gazette of Paper Manufacturing] shows a schematic diagram in which a cloth belt is partially wound or guided around the flexible roll jacket. However, a device such as this has not been put into actual use because of various obstacles, including that the deflection stress that is produced in the center region and on the edges of the flexible roll jacket, and increased problems with a formation of the lubricating film.

SUMMARY OF THE INVENTION

An object of the present invention may be to produce an improved press device as generally discussed above which does not suffer the noted drawbacks. Further, according to the present invention, a cloth belt may be positioned against the flexible roll jacket before entering the press gap, without disadvantageous results, so that it already comes into contact with the flexible roll jacket in the region of the complementary, e.g., convex, curved nose of the press shoe to the opposing face. In this regard, it should, e.g., be possible that an angle formed between a press plane and a supplied cloth belt may be smaller than 90°.

The object may achieved according to the present invention in that the support element may be provided with an entry face for the flexible roll jacket and for the cloth belt. This entry face may located before a compression face and, thus, before the press gap in the travel direction of the sheet of material.

With a corresponding supply of the cloth belt, the flexible roll jacket consequently strikes against the support element together with the cloth belt in a region of the entry face. Because of the specific entry face, in accordance with the present invention, a support that is gentle to the material may be provided, for both the flexible roll jacket and the respective cloth belt, in a region that is located before the press gap in the travel direction of the sheet of material. By the association of the entry and the support element, deflection stresses may be reduced to a minimum.

The entry face of the support element may be, e.g., hydrodynamically lubricated. Advantageously, the support element may be directly coupled to the press face of the support element, which is arranged to face the region of the press gap.

The opposing face may include by an opposing roll. If the opposing face includes an opposing roll, then a compression face of the support element may be suitably concave, i.e., complementary to the outer circumference of the opposing roll, to form the elongated press gap, i.e., elongated in the travel direction of the sheet of material.

Alternatively, the entry face in the region of the support element supporting the flexible roll jacket may be at least partially convex and may be provided with a curvature radius that lies in the range between approximately 5% to 15% of a radius of an approximately circular cylindrical free part of the roll jacket. In this regard, the curvature radius of the support face may advantageously be within the range of, e.g., approximately 30 mm to 120 mm, and in particular, approximately 50 mm to 75 mm.

In addition, the support element may be provided with a curved incoming (edge) region that may be located before the support face in the travel direction of the sheet of material, whose curvature radius is preferably considerably smaller than the curvature radius of the entry face.

In an exemplary preferred embodiment, the curvature radius of the support face may be within a range of, e.g., approximately 5% to 15% and, in particular, may be 10% of the entry face radius of curvature, e.g., approximately 6 mm.

The sheet of material may include, e.g., fibrous material, and may be guided into the press gap either with the cloth belt or independently of the belt cloth, e.g., wound partially around the opposing roll.

To optimize the hydrodynamic formation of the lubricating film and to prevent excessive three dimensional deformations of the flexible roll jacket on the two shoe ends, it may be advantageous if the jacket, e.g., plastic, exhibits a rigidity that is neither too high or too low. Therefore, according to the present invention, a new, i.e., not-yet worn out, roll jacket may have a thickness within a range between approximately 5 to 7 mm, may have a hardness in a range between approximately 85 to 96 on the Shore hardness scale, and may have a radius, i.e., of an approximately circular cylindrical portion of the roll jacket, within a range between approximately 400 to 800 mm.

The present invention may be directed to a press device for treating a sheet of material in a press gap elongated in a travel direction of the sheet of material. The press device may include a flexible roll jacket that runs around a stationary carrier, an opposing face that forms the elongated press gap with the flexible roll jacket, at least one of a hydrodynamically and hydrostatically lubricated support element supported on the carrier. The support element may include a compression face adapted to a shape of the opposing face and at least one cloth belt guided through the elongated press gap. The support element may further include an entry face for the flexible roll jacket and for the cloth belt and positioned adjacent and upstream of the compression face in the travel direction of the sheet of material.

According to another feature of the present invention, the entry face may be hydrodynamically lubricated.

According to another feature of the present invention, the entry face may be positioned directly adjacent to the compression face located in a region of the elongated press gap.

According to still another feature of the present invention, the roll jacket may follow an approximately circular cylindrical course in a region outside of the support element.

According to another feature of the present invention, an opposing roll may include the opposing face and the compression face may include a concave surface.

According to a further feature of the present invention, the entry face may be at least a partially convex surface in a region supporting the flexible roll jacket and the at least partially convex surface may include a curvature radius between approximately 5% to 15% of a radius of an approximately circular cylindrical free portion of the roll jacket.

According to another feature of the present invention, the entry face may include a curvature radius between approximately 35 mm to 100 mm. Further, the curvature radius may be between approximately from 45 mm to 75 mm.

According to a still further feature of the present invention, the roll jacket may travel a predetermined path that deviates, in a vicinity of the entry face, from an ideal circular course of the roll jacket by a predefined amount and the predefined amount may be approximately 2% of a radius of an approximately circular cylindrical free part of the roll jacket.

According to still another feature of the present invention, the support element may include a curved incoming region located before the entry face in the travel direction and a curvature radius of the incoming region may be less than a curvature radius of the entry face.

According to a further feature of the present invention, the curvature radius of the incoming region may be between approximately 5% to 15% of curvature radius of the entry face and may be approximately 6 mm.

According to another feature of the present invention, the curvature radius of the incoming region may be approximately 10% of the curvature radius of the entry face.

According to still another feature of the present invention, the curvature radius of the incoming region may be approximately 6 mm.

According to another feature of the present invention, a thickness of the roll jacket may be between approximately 5 to 7 mm, a material hardness of the roll jacket plastic being between approximately 85 to 96 on the Shore hardness scale, and a radius of an approximately circular cylindrical roll jacket being between approximately 400 to 800 mm.

According to another feature of the present invention, the device may also include a lubricant having a viscosity between approximately 50 and 150 mm $^2$/s at 40° C.

According to another feature of the present invention, the device may also include a lubricant aspiration device located before the support element in the travel direction and may include oil aspiration conduits distributed over a width defined by walls and a continuously curved guide face positioned at a slight spacing from the roll jacket during normal operation.

According to a further feature of the present invention, only one cloth belt may be guided through the press gap, and the cloth belt may wind onto the flexible roll before the press gap, in the travel direction, and wind onto the opposing face by a predetermined amount after the press gap.

According to another feature of the present invention, the support element may include a press shoe.

The present invention may be directed to a press device for treating a sheet material. The device may include a flexible roll jacket, including a predetermined radius, rotating in a rotation direction, an opposing roll, and a press shoe, exerting a pressure on an inside surface of the flexible roll jacket and forming an extended nip in a direction of rotation. The press shoe may include a compression portion for adjusting to an outer surface of opposing roll and an entry portion including a rounded surface for facilitating entry into the extended nip. The sheet material may be guided through the extended nip.

According to another feature of the present invention, the press shoe may further include a lubricant supply conduit for lubricating the press shoe against the inside surface.

According to another feature of the present invention, the rounded surface of the entry portion may include a predetermined curvature radius.

According to another feature of the present invention, the predetermined curvature radius may be within a range between approximately 5% and 15% of the predetermined diameter of the flexible roll jacket.

According to a further feature of the present invention, the predetermined curvature radius may be between approximately 35 mm and 100 mm.

According to still another feature of the present invention, a cloth belt may guided through the extended nip with the sheet material. Further, the sheet material and the cloth material may be guided into the extended nip along different paths and the sheet material and the cloth belt may converge at the entry portion.

According to another feature of the present invention, the cloth belt may abut a least a portion of the flexible jacket upstream of the entry point.

According to a still further feature of the present invention, the entry portion may contact the inside surface to deviate a circular path of the flexible roll jacket. Further, the circular path may be deviated by a distance of approximately 2% of the predetermined radius.

According to another feature of the present invention, the device may also include a press plane and a cloth belt to be guided through the extended nip. The cloth belt may enter the entry portion along a path formed at a predetermined angle to the press plane. Further, the predetermined angle may be less than approximately 90°.

According to another feature of the present invention, the press shoe may include an upstream portion with respect to the rotation direction and may have a first and second curved portion. The first curved portion may include an incoming portion having a curvature radius between approximately 5% and 15% of the second curvature portion, which includes the entry portion. The first portion may be located upstream of the second portion.

According to another feature of the present invention, the curvature radius of the first curved portion may be approximately 6 mm.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the invention may be embodied in practice.

Figure 1:
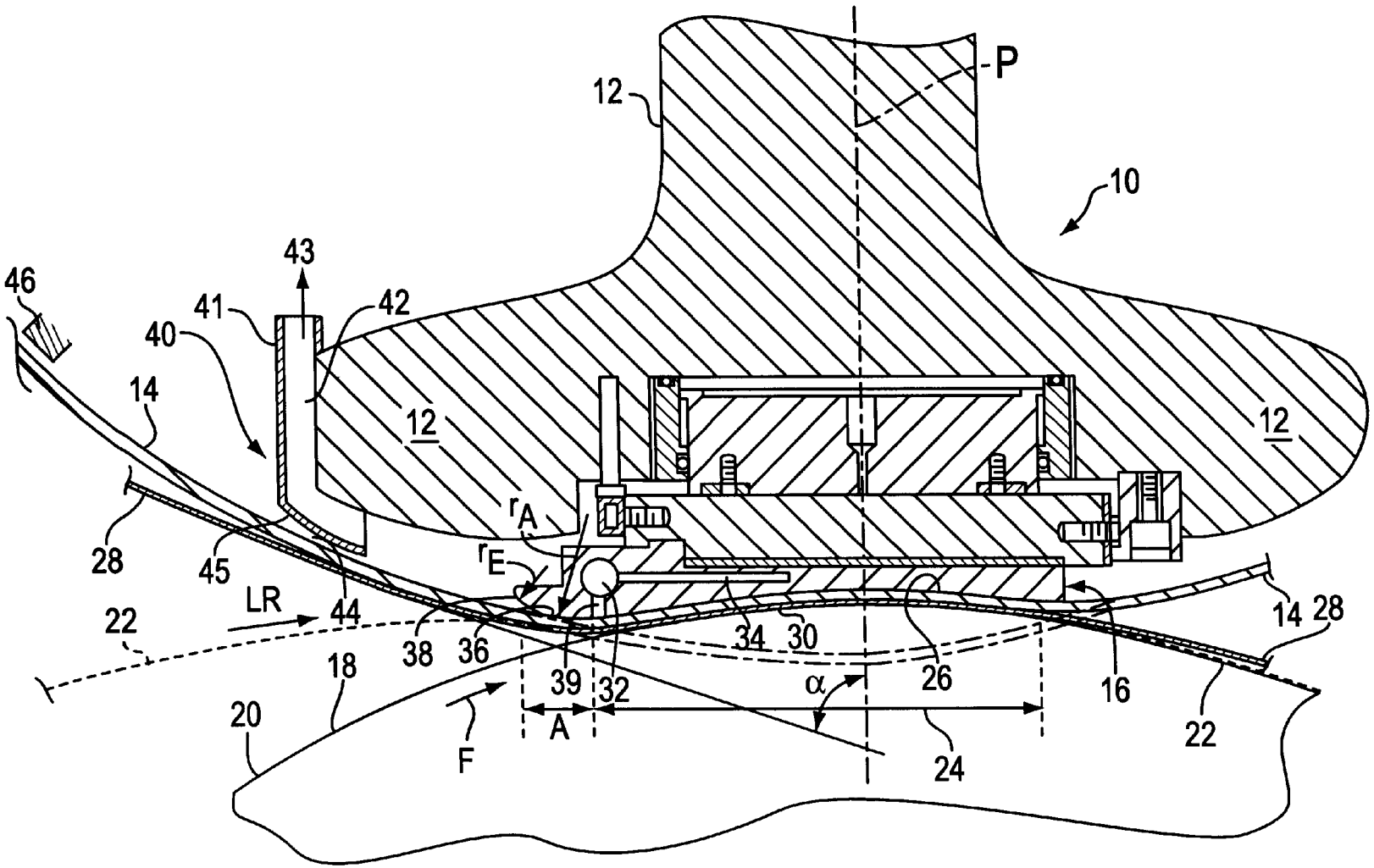
FIG. 1 illustrates a schematic and partially sectional view of a portion of a shoe press device.

A shoe press device 10 illustrated in FIG. 1 may include a flexible roll jacket 14 that rotates or runs around a stationary carrier 12. A press shoe 16, which may be a support element for flexible roll jacket 14 and may be supported by stationary carrier 12, may press flexible roll jacket 14 against an opposing face 18, which may be, e.g., a cylindrical opposing roll 20.

Shoe press device 10 may be used for treating a sheet of material 22 in a press gap or nip 24 that may elongated in a travel direction LR of sheet of material 22. Press nip 24 may be defined in a region of a compression face 26 of press shoe 16, i.e., between flexible roll jacket 14 and opposing face 18 of opposing roll 20. In this regard, a shape of compression face 26 may be complementary and/or adapted or adaptable to a shape of the outer surface of opposing face 18, so as to form elongated press gap 24. For example, because opposing roll 20, as depicted in FIG. 1, exhibits a circular and cylindrical shape, compression face 26 may be a concave surface substantially matching the curvature of the outer surface of opposing roll 20.

In addition to sheet of material 22 to be treated, at least one cloth belt 28, e.g., a de-watering felt, a water removal screen, or the like, may be guided through press gap 24.

Press shoe 16 may be provided with hydrostatic pockets 30 that may be supplied with lubricating oil through conduits 32, 34, which may also be within press shoe 16. In practice, however, press shoe 16 may be hydrodynamically and/or hydrostatically lubricated.

As can be seen from the exemplary embodiment depicted in Figure opposing roll 20 may rotate in the clockwise direction, as shown by arrow F. The rotation of opposing roll 20 may also produce a corresponding travel direction LR for sheet of material 22.

Press shoe 16 may be provided with an entry face 36 for flexible roll jacket 14 and for cloth belt 28. Entry face 36 may be located before compression face 26 in the travel direction LR. Entry face 36, which may also extend over a predetermined region A, may be lubricated, e.g., hydrodynamically, and/or further lubricated, e.g., hydrostatically, through bores 39.

As depicted in FIG. 1, entry face 36 may be coupled, e.g., directly, to compression face 26 of press shoe 16 and entry face 36 may also be arranged to be within the region of the press gap 24.

Entry face 36 may be convex and, therefore, may have a shape opposite the concave shape of compression face 26. The curvature radius $r_A$ of the entry (support) face 36 may be within a range between approximately 5% to 15% of a radius of roll jacket 14, i.e., of a portion guided outside the region of press shoe 16. In this manner, this curvature radius $r_A$ of support face 36 may be within a range between, e.g., approximately 35 mm to 100 mm, and, in particular, from approximately 50 mm to 75 mm.

Figure 2:
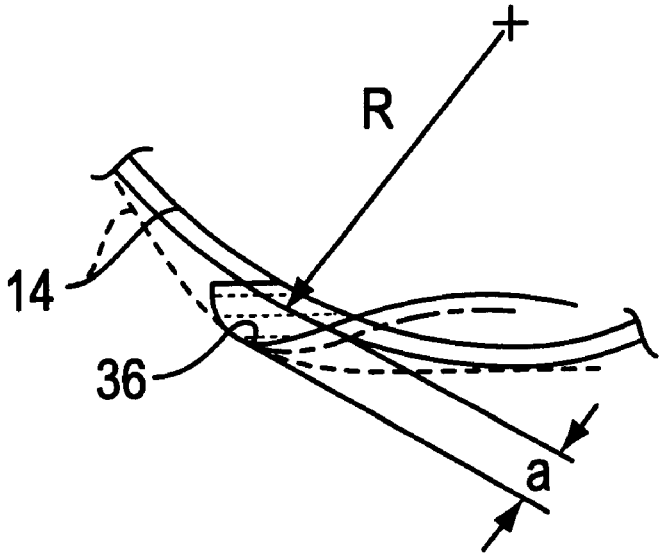
FIGS. 2 and 3 each illustrate a possible course of travel for the roll jacket in a region of an entry face.
Figure 3:
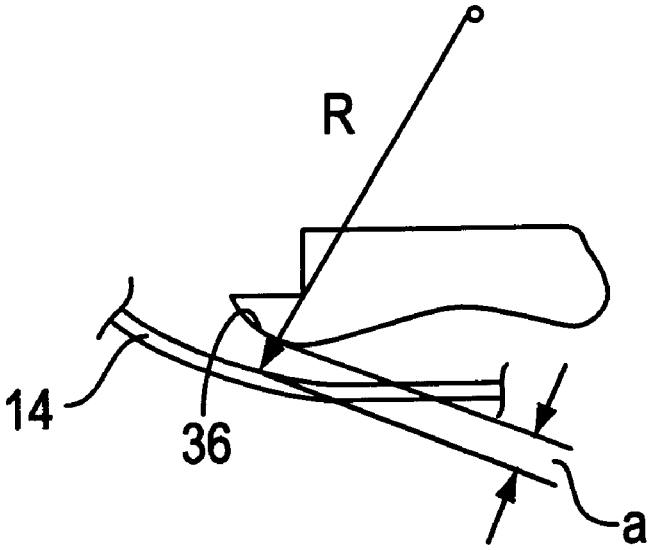

Due to the features of the present invention, a gentler more gradual transition may be produced between entry face 36 and compression face 26. Thus, material stress may be reduced to a minimum. In the preferred embodiment, the course of roll jacket 14, i.e., within the region of entry face 36, may deviate from an assumed ideal circular course of the roll jacket 14, e.g., at most by an amount a (shown in FIGS. 2 and 3), which may be approximately 2% of a radius R of the approximately circular cylindrical free part of roll jacket 14.

Further, press shoe 16 may be provided with a curved incoming region 38 that may be located before support face 36 in the travel direction LR. Incoming region may have a radius of curvature $r_E$ that may be smaller than curvature radius $r_A$ of entry face 36.

Curvature radius $r_E$ may be within a range between, e.g., approximately 5% to 15%, and, in particular, approximately 10% of curvature radius $r_A$ of entry face 36. In the exemplary embodiment, curvature radius $r_E$ may be, e.g., approximately 6 mm with a roll jacket radius of, e.g., approximately 750 mm.

Cloth belt 28 may be arranged to rest against or abut the flexible roll jacket prior to traversing entry face 36.

Sheet of material 22 may include, e.g., fibrous material, and may be provided into press gap 24 either with cloth belt 28, or, as shown in FIG. 1, independently of cloth belt 28. In this regard, sheet of material 22 may enter press gap 24 in contact with opposing roll 20.

Due to the above-noted features, the present invention ensures that flexible roll jacket 14 will strike against or abut press shoe 16 together with cloth belt 28 and/or sheet of material 22 in the region of the hydrodynamically lubricated entry face 36.

Because curvature radius $r_E$ of incoming region 38 may be significantly smaller than curvature radius $r_A$ of entry face 36, roll jacket 14 and cloth belt 28 may rest against or abut support shoe 16, at least substantially only in the region of the entry face 36.

Because of the structural features of press shoe 16, in accordance with the exemplarly embodiment of the present invention, including entry face 36, a considerably reduced deflection stress may be produced for both flexible roll jacket 14 and cloth belt 28. This reduced deflection stress may be evident when a path of roll jacket 14 in the entry region 36 deviates from an ideal, i.e., a circular, path of the roll jacket 14, (indicated with dot-and-dash lines) by maximally 2% of the radius of roll jacket 14.

Further, an additional cloth belt may be provided, e.g., in addition to cloth belt 28, to be guided through press gap 24.

A lubricant aspiration device 40 may be provided before support element 16, i.e., with respect to travel direction LR, and may include oil aspiration conduits 42 distributed over an entire width, i.e., substantially parallel to the rotational axes of roll jacket 14 and opposing roll 20. Oil aspiration conduits 42 may be defined by walls 41 and may have a continuously curved guide face 45 which may be disposed at a slight spacing 44 from roll jacket 14, i.e., in normal operation.

In a non-stationary state (acceleration, delay, air pressure drop in the press jacket, etc.), roll jacket 14 may be tightened prior to winding onto press shoe 16, i.e., in accordance with an approximately tangential path between guide rail 46 and press shoe 16. Guide face 45 may be provided with a predetermined curvature such that a required lubricating oil quantity may be supplied, i.e., in the non-stationary state.

Thus, for example, the radius of curvature for guide face 45 may be, e.g., greater than approximately 40 mm.

In exemplary embodiment discussed herein, only one cloth belt 28 or felt has been guided through press gap 24. Cloth belt 28 may wind onto the flexible roll prior to the press gap and may wind onto rigid opposing roll 20 by a particular amount after press gap 24.

Further, as shown in FIG. 1, an angle α may be formed between press plane P and cloth band 28 running with flexible roll jacket 14 to be, e.g., less than 90°.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

List of Reference Numerals

10 shoe press device
12 carrier
14 roll jacket
16 press shoe
18 opposing face
20 opposing roll
22 sheet of material
24 press gap
26 compression face
28 cloth belt
30 hydrostatic pocket
32 conduit
34 conduit
36 entry face
38 edge region
40 lubricant aspiration device
41 walls
42 oil aspiration conduits
44 space
45 guide face
46 guide rail
A region
F arrow
LR travel direction of the sheet of material
$r_A$ curvature radius
$r_E$ curvature radius
p press plane
α angle

What is claimed is:

1. A press device for treating a sheet of material in a press nip elongated in a travel direction of the sheet of material comprising:

a flexible roll jacket that runs around a stationary carrier;

an opposing face that forms the elongated press nip with the flexible roll jacket;

at least one of a hydrodynamically and hydrostatically lubricated support element supported on the carrier;

the support element comprising a compression face adapted to a shape of the opposing face;

at least one cloth belt guided through the elongated press nip;

the support element further comprising an entry face for the flexible roll jacket and for the cloth belt and positioned before the compression face in the travel direction of the sheet of material;

the entry face being hydrodynamically lubricated; and a lubricant aspiration device located before the support element in the travel direction comprising oil aspiration conduits distributed over a width defined by walls and a continuously curved guide face positioned at a slight spacing from the roll jacket during normal operation.

2. The press device according to claim 1, the entry face positioned directly adjacent to the compression face located in a region of the elongated press gap.

3. The press device according to claim 1, the roll jacket follows an approximately circular cylindrical course in a region outside of the support element.

4. The press device according to claim 1, an opposing roll comprising the opposing face and the compression face comprising a concave surface.

5. The press device according to claim 1, the entry face being at least a partially convex surface in a region supporting the flexible roll jacket and the at least partially convex surface comprising a curvature radius between approximately 5% to 15% of a radius of an approximately circular cylindrical free portion of the roll jacket.

6. The press device according to claim 1, the entry face comprising a curvature radius between approximately 35 mm to 100 mm.

7. The press device according to claim 6, the curvature radius between approximately from 45 mm to 75 mm.

8. The press device according to claim 1, the roll jacket traveling a predetermined path that deviates, in a vicinity of the entry face, from an ideal circular course of the roll jacket by a predefined amount; and the predefined amount comprising approximately 2% of a radius of an approximately circular cylindrical free part of the roll jacket.

9. The press device according to claim 1, the support element comprising a curved incoming region located before the entry face in the travel direction; and a curvature radius of the incoming region being less than a curvature radius of the entry face.

10. The press device according to claim 8, the curvature radius of the incoming region being between approximately 5% to 15% of curvature radius of the entry face.

11. The press device according to claim 10, the curvature radius of the incoming region being approximately 10% of the curvature radius of the entry face.

12. The press device according to claim 10, the curvature radius of the incoming region being approximately 6 mm.

13. The press device according to claim 1, a thickness of the roll jacket being between approximately 5 to 7 mm, a material hardness of the roll jacket plastic being between approximately 85 to 96 on the Shore hardness scale, and a radius of an approximately circular cylindrical roll jacket being between approximately 400 to 800 mm.

14. The press device according to claim 13, further comprising a lubricant having a viscosity between approximately 50 and 150 $mm^2/s$ at 40° C.

15. The press device according to claim 1, only one cloth belt is guided through the press gap, wherein the cloth belt winds onto the flexible roll before the press gap, in the travel direction, and winds onto the opposing face by a predetermined amount after the press gap.

16. The press device according to claim 1, the press device being a shoe press device and the support element comprising a press shoe.

17. A press device for treating a sheet material comprising:

a flexible roll jacket, comprising a predetermined radius, rotating in a rotation direction;

an opposing roll;

a press shoe, exerting a pressure on an inside surface of the flexible roll jacket, forming an extended nip in a direction of rotation;

the press shoe comprising a compression portion for adjusting to an outer surface of opposing roll and an entry portion including a rounded surface for facilitating entry into the extended nip;

the entry portion being hydrodynamically lubricated against the inside surface, wherein the sheet material is guided through the extended nip; and a lubricant aspiration device located before the support element in the travel direction comprising oil aspiration conduits distributed over a width defined by walls and a continuously curved guide face positioned at a slight spacing from the roll jacket during normal operation.

18. The press device according to claim 17, the press shoe further comprising a lubricant supply conduit for lubricating the press shoe against the inside surface.

19. The press device according to claim 17, the rounded surface of the entry portion comprising a predetermined curvature radius.

20. The press device according to claim 19, the predetermined curvature radius within a range between approximately 5% and 15% the predetermined diameter of the flexible roll jacket.

21. The press device according to claim 19, the predetermined curvature radius being between approximately 35 mm and 100 mm.

22. The press device according to claim 17, further comprising a cloth belt guided through the extended nip with the sheet material.

23. The press device according to claim 22, wherein the sheet material and the cloth material being guided into the extended nip along different paths, wherein the sheet material and the cloth belt converge at the entry portion.

24. The press device according to claim 23, the cloth belt abutting a least a portion of the flexible jacket upstream of the entry point.

25. The press device according to claim 17, wherein the entry portion contacts the inside surface to deviate a circular path of the flexible roll jacket.

26. The press device according to claim 25, the circular path deviated by a distance of approximately 2% of the predetermined radius.

27. The press device according to claim 17, further comprising a press plane and a cloth belt to be guided through the extended nip, wherein the cloth belt enters the entry portion along a path formed at a predetermined angle to the press plane.

28. The press device according to claim 27, the predetermined angle being less than approximately 90°.

29. The press device according to claim 17, the press shoe comprising an upstream portion with respect to the rotation direction having a first and second curved portion.

30. The press device according to claim 29, the first curved portion comprising an incoming portion having a curvature radius between approximately 5% and 15% of the second curvature portion comprising the entry portion, wherein the first portion is located upstream of the second portion.

31. The press device according to claim 30, the curvature radius of the first curved portion being approximately 6 mm.

* * * * *